US005278614A

United States Patent [19]

Ikegawa et al.

[11] Patent Number: 5,278,614

[45] Date of Patent: Jan. 11, 1994

[54] CONTACT CHARGER AND IMAGE FORMING APPARATUS INCORPORATING THE CONTACT CHARGER

[75] Inventors: Akihito Ikegawa, Sakai; Masaki Asano, Amagasaki; Shuji Iino, Hirakata; Izumi Osawa, Ikeda, all of Japan

[73] Assignee: Minolta Camera Kabushiki Kaisha, Osaka, Japan

[21] Appl. No.: 46,163

[22] Filed: Apr. 15, 1993

[30] Foreign Application Priority Data

May 15, 1992 [JP] Japan ..... 4-123302

[51] Int. Cl.[5] ..... G03G 15/02

[52] U.S. Cl. ..... 355/219; 361/225; 361/230

[58] Field of Search ..... 355/219; 361/225, 230, 361/235

[56] References Cited

U.S. PATENT DOCUMENTS

| | | | |
|---|---|---|---|
| 4,851,960 | 7/1989 | Nakamura et al. | 361/225 |
| 5,060,014 | 10/1991 | Adachi et al. | 355/211 |
| 5,068,762 | 11/1991 | Yoshihara | 361/225 |
| 5,192,974 | 3/1993 | Ikegawa et al. | 355/219 |

FOREIGN PATENT DOCUMENTS

| | | | |
|---|---|---|---|
| 0308185 | 3/1989 | European Pat. Off. . | |
| 0439145 | 1/1991 | European Pat. Off. . | |
| 0439143 | 7/1991 | European Pat. Off. . | |
| 0127324 | 10/1979 | Japan | 355/219 |
| 58-158665 | 9/1983 | Japan . | |
| 1-93761 | 4/1989 | Japan . | |
| 1-261675 | 10/1989 | Japan . | |
| 1-267667 | 10/1989 | Japan . | |
| 2-282279 | 11/1990 | Japan . | |
| 0067073 | 3/1992 | Japan | 355/219 |

*Primary Examiner*—A. T. Grimley
*Assistant Examiner*—William J. Royer
*Attorney, Agent, or Firm*—Burns, Doane, Swecker & Mathis

[57] ABSTRACT

A contact charger for charging an image bearing member includes a support member, a flexible film supported by the support member and having a free end adapted to contact the surface of the image bearing member, and a power device for applying a charging voltage to the flexible film wherein the flexible film has an electrically conductive substrate layer and an electrically insulated overcoat layer superposed onto the substrate layer.

17 Claims, 6 Drawing Sheets

CONTACT CHARGER AND IMAGE FORMING APPARATUS INCORPORATING THE CONTACT CHARGER

BACKGROUND OF THE INVENTION

1. FIELD OF THE INVENTION

The present invention relates to a contact charger for use in image forming apparatus such as electrophotographic copying apparatus, printers and the like.

2. DESCRIPTION OF THE RELATED ART

In image forming apparatus such as electrophotographic copying apparatus, printers and the like, an image carrier such as a photosensitive drum and the like is electrically charged by a charging device, and an optical image is exposed on the charged area of the image carrier to form an electrostatic latent image thereon. This latent image is then developed so as to be rendered visible, transferred onto a transfer sheet and fused thereon.

Notable among charging devices of the aforesaid type are contact chargers which produce much less ozone than do conventional corona chargers.

Chargers of the contact type have certain disadvantages in that some use a charging brush which is difficult to fabricate, and some use a charging roller which is not only difficult to manufacture because it requires a driving means, but may also develop "creep" deformation distortion resulting from contact of the charging roller with the image carrier when the image forming apparatus is stopped, thereby causing inadequate charging. Blade type contact chargers are disadvantageous in that the blade is difficult to set with precision. Furthermore, a strong blade coming into contact with the surface of the image carrier may result in damage to the image carrier, and a large torque is necessary to rotate the image carrier. Contact chargers which use a rotating type endless belt for charging tend to enlarge the apparatus overall, and pose a further complexity of a belt drive method.

Contact chargers are difficult to manufacture, complex in construction, and enlarge the apparatus. The complexity of the charger driving means is currently a significant obstacle hindering the production of compact, low cost image forming apparatus.

SUMMARY OF THE INVENTION

A main object of the present invention is to provide a contact charger of high reliability, which is capable of superior charging in a stable state, and provides a simplified and economical construction compared to conventional contact chargers.

The inventors of the present invention, through extensive research into methods for resolving the previously described disadvantages, have discovered certain solutions to these problems by using a film to accomplish charging, said film having a two-layer construction comprising a conductive layer and an insulating overcoat layer, such that when said insulating layer comes into contact with the image carrier, a constant distance is maintained between the charging layer and the surface of the image carrier by means of an insulating overcoat layer so as to control the electrical charge imparted, and control toner adhesion to the conductive layer.

That is, the present invention provides a contact charger comprising a flexible charging film, one end of which is supported and the free end of which is capable of making contact with the image carrier, said film having a two-layer construction comprising an insulating overcoat layer and a conductive layer, and wherein said insulating overcoat layer makes contact with the image carrier.

BRIEF DESCRIPTION OF THE DRAWINGS

These and other objects and features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE INVENTION

Figure 4:
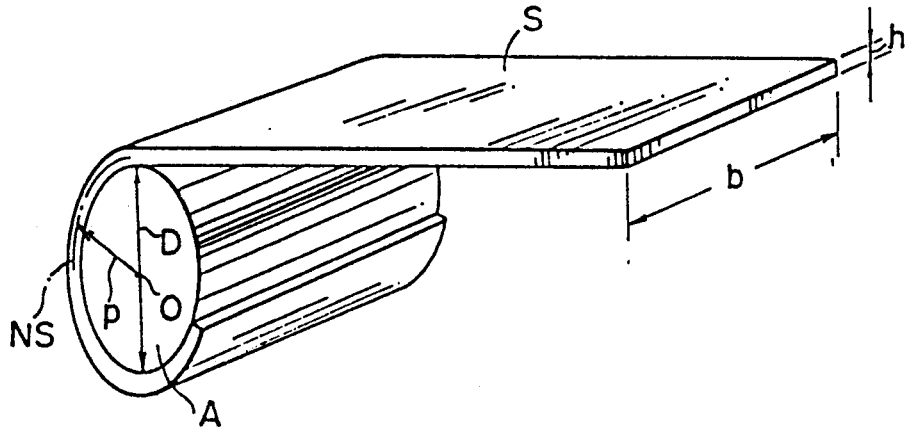
FIG. 4 is an illustration defining the film charger of the present invention.

The flexible film of the present invention incorporating an electrically conductive layer and an insulating overcoat layer may, such as is illustrated in FIG. 4, has a bending moment M which is preferably $M \leqq 20$ [g.cm], and ideally $M \leqq 10$ [g.cm], when a material S having a width b of 1 cm is wrapped around a core member A having a circular cross section with a major diameter D of 1 cm.

The bending moment M is a numerical value determined by the formula $M = EI/\rho$, that is, $I = bh^3/12$. E is the Young's modulus ($g/cm^2$) for the film, I is the second moment of area ($cm^4$), and $\rho$ is a radius of curvature (cm). The center of curvature, i.e., the distance of the center 0 of the core member A and the film's median section NS, and h is the film thickness (cm).

When the bending moment M exceeds 20 (g.cm), the film does not make proper contact with the surface of the image carrier, which produces irregularities in the electrical potential on the surface of the image carrier, resulting in the marked occurrence of image noise. This effect is undesirable.

Although the lower limit value of the bending moment M is not specifically restricted, it is preferably 0.001 (g.cm) or greater due to separate factors for maintaining the mechanical strength (e.g., the strength to prevent cracking, tearing and the like of the film) necessary for use in contact charging.

Metallic materials and resin materials useful as material for constructing the electrically conductive layer of the flexible charging film are considered hereinafter.

Metals such as aluminum, gold, copper, iron, silver, chromium, nickel, platinum, tin, titanium and the like, or metal alloys thereof are examples of useful metallic materials.

Resin materials such as polyethylene, polypropylene, polyvinyl alcohol, polyvinyl acetate, ethylene-vinyl acetate copolymer, polymethyl methacrylate, polycarbonate, polystyrene, acrylonitrile-methacrylate copolymer, acrylonitrilebutadiene-styrene copolymer, polyethylene terephthalate, polyurethane elastomer, viscose rayon, cellulose nitrate, cellulose acetate, cellulose triacetate, cellulose propioniate, cellulose acetylbutylate, ethyl cellulose, regenerated cellulose, polyamide (nylon 6, nylon 66, nylon 11, nylon 12, nylon 46), polyimide, polysulfone, polyether sulfone, polyvinyl chloride, vinyl chloride-vinyl acetate copolymer, polyvinylidene chloride, vinylidene chloride-vinyl chloride copolymer, vinylnitrile rubber alloy, polytetraflouroethylene, polychlorofluoroethylene, polyvinyl fluoride, polyvinylidene fluoride and the like are examples of useful resins (originally insulating materials) in which may be dispersed electrically conductive materials. The surface of the aforesaid resin materials, when subjected to a process of electrical conduction, produce a suitable electrical conductivity and low electrical resistance.

More specifically, when metal powder, metal whiskers, carbon black, carbon fibers and the like are incorporated in the resin, low electrical resistance ranging from $10^3 \sim 10^8$ Ω.cm may be achieved. The thickness of the resin layer is normally $5 \sim 300$ μm.

Examples of materials useful for the insulating overcoat layer of the flexible charging film are listed hereinafter.

Polyester, polypropylene, polyvinyl alcohol, polyvinyl acetate, ethylene-vinyl acetate copolymer, polymethyl methacrylate, polycarbonate, polystyrene, acrylonitrile-methacrylate copolymer, acrylonitrile-butadiene-styrene copolymer, polyethylene terephthalate, polyurethane elastomer, viscose rayon, cellulose nitrate, cellulose acetate, cellulose triacetate, cellulose propioniate, cellulose acetylbutylate, ethyl cellulose, regenerated cellulose, polyamide (nylon 6, nylon 66, nylon 11, nylon 12, nylon 46 and the like), polyimide, polysulfone, polyether sulfone, polyvinyl chloride, vinyl chloride-vinyl acetate copolymer, polyvinylidene chloride, vinylidene chloride-vinyl chloride copolymer, vinylnitrile rubber alloy, polytetraflouroethylene, polychlorofluoroethylene, polyvinyl fluoride, polyvinylidene fluoride and like resins, as well as $Al_2$, $O_3$, $AiO_2$, $TiO_2$ and like ceramic to inorganic materials may be used.

The electrically conductive layer and the electrically insulating overcoat layer may be comprised of mixtures of two or more materials. The formation of the insulating overcoat layer may be accomplished by application, i.e., painting and the like, of an insulating material over the conductive layer when said insulating material is a resin. When the insulating material is a ceramic or the like, it may be applied by superimposing said material on the conductive substrate by vacuum deposition, ceramic particularization, or by dispersing the ceramic in a suitable binder resin and applying the fluid dispersion by painting or the like.

The electrical resistivity of the insulating overcoat layer of the charging film is preferably $10^{16}$ Ωcm or greater to restrict the injected charge. A layer thickness of about $0.1 \sim 100$ μm is considered. When the layer thickness is less than 0.1 μm, the expected injection charge restricting effect is difficult to achieve, and when the layer thickness exceeds 100 μm, charging becomes difficult such that the discharge voltage must be greatly increased.

The electrical resistivity of the conductive layer of the charging film should be about $10^{-4}$ Ωcm or greater from the perspective of the conductive layer, and should be about $10^{10}$ Ωcm or less from the perspective of the ease of charging.

Figure 8:
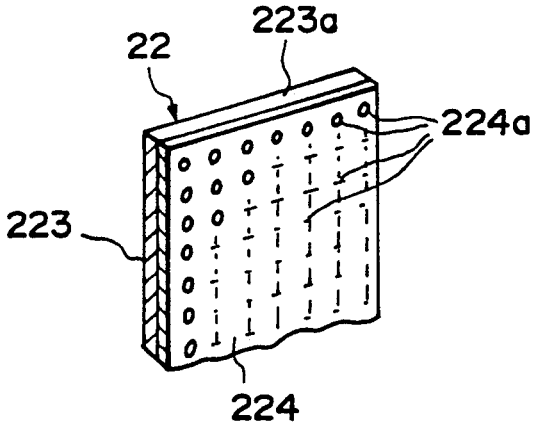
FIG. 8 is an illustration showing a modification of an embodiment of the present invention.

The surface of the insulating overcoat layer may uniformly cover the surface of the conductive substrate layer, a plurality of pores also may be opened in the insulating overcoat layer, as shown in FIG. 8. When the insulating overcoat layer is provided with the aforesaid plurality of pores, the electrical discharging occurs not only from the free end of the conductive substrate layer of the film, but also occurs from said pores and, therefore, the points of discharge are increased and thereby produce uniform discharging. Furthermore, charging film easily bonds to the surface of the image carrier, and by this point alone produces uniform discharging For example, in the area of nip d in the arrangement shown in FIG. 2, the film of the aforesaid construction is capable of bonding to the image carrier for about $1 \sim 20$ mm, and is capable of uniform discharging when the nip width is 8 mm, for example. The charge voltage also may be applied via the pores, which have a diameter of $0.05 \sim 1.00$ mm, for example, and may have a porosity of about $70 \sim 80\%$.

The formation of the aforesaid pores, may be accomplished, for example, by an etching process or the like performed on the insulating overcoat layer uniformly superimposed on the conductive substrate layer. The configuration of the pores is not limited inasmuch as said pores may be square, triangular, or another indefinite shape.

The charging voltage that is applied to the flexible charging film may be a voltage of direct current, alternating current or superimposition of one upon another. In such a case, the direct current component is preferably |700–1500| volts, and the alternating current component is preferably |300–1000| volts, at a frequency from about 50 Hz to 1 kHz.

According to the charging device of the present invention, an insulating overcoat layer provided on a portion or the entirety of the free end of a flexible film to which is applied a charging voltage, i.e., from the supported end of the film to the free end of the film, comes into contact with the surface of an image carrier and charges the surface of said image carrier to a predetermined electric potential via a discharge occurring from the free end of the conductive substrate layer or from pores when discharging pores are formed in the insulating overcoat layer.

EMBODIMENT 1

A first embodiment of the invention is described hereinafter with reference to the drawings.

All embodiments discussed below are incorporated in the printing apparatus described in FIG. 1. The printing apparatus in FIG. 1 is described hereinafter.

Figure 1:
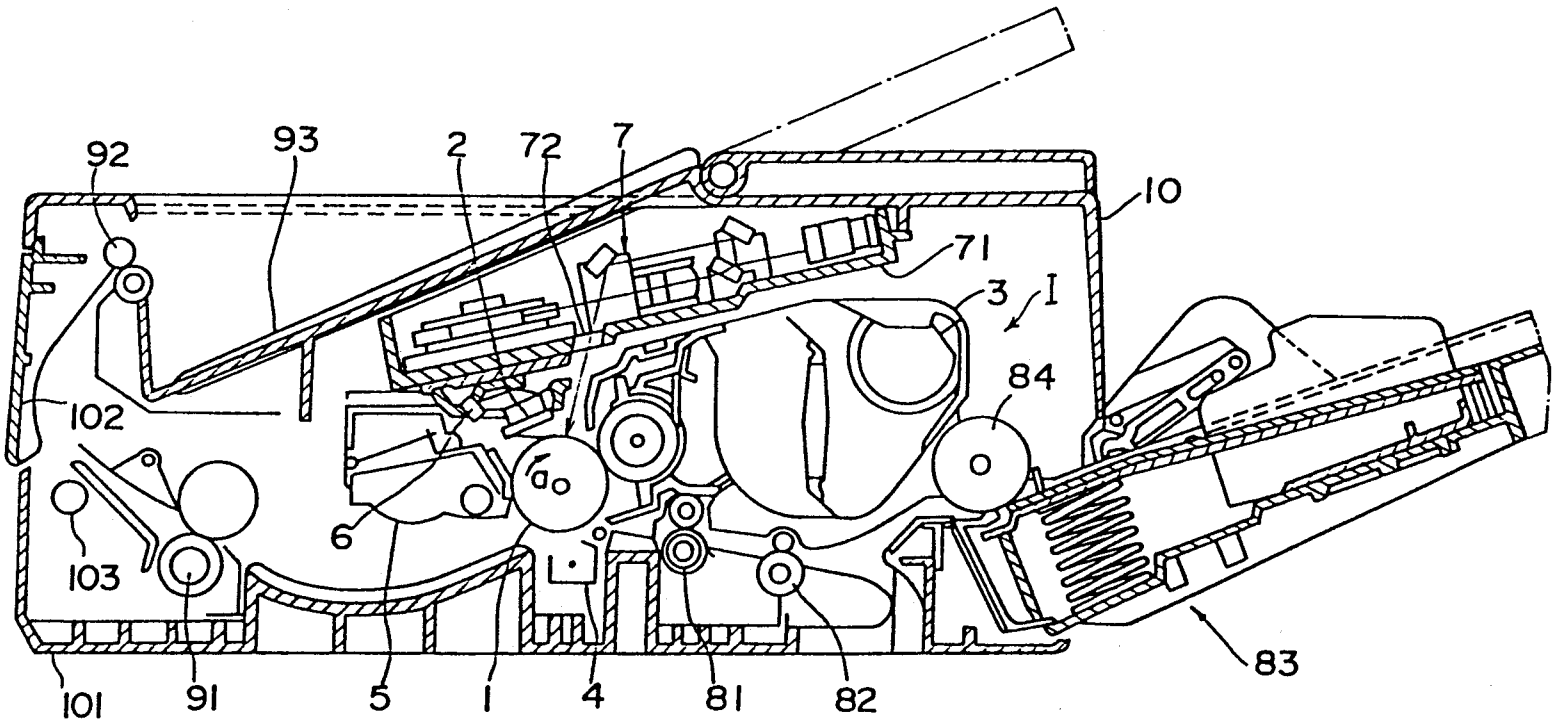
FIG. 1 is a section view showing a printer of an embodiment of the present invention.

The printer in FIG. 1 is provided with a centrally arranged photosensitive drum 1 as the electrostatic latent image carrier. The photosensitive drum 1 is rotatably driven in the direction indicated by the arrow a, via a driving means not shown in the illustration. Arranged sequentially around the periphery of the photosensitive drum 1 are a charger 2, developing unit 3, transfer charger 4, cleaning device 5, and eraser 6. The charger 2 is the contact charger of the present invention.

An optical unit 7 is disposed above the photosensitive drum 1. The optical unit 7 comprises within a housing 71 a semiconductor laser generator, polygonal mirror, toroidal lens, half-mirror, spherical mirror, folding mirror, reflecting mirror and the like. An exposure slit 72 is formed in the base of the housing 71. Image exposure light passes from the aforesaid slit 72, passes between the charger 2 and the developing unit 3, and irradiates the surface of the photosensitive drum 1.

At the right side of the photosensitive drum I in the drawing, are sequentially arranged a pair of timing rollers 81, pair of intermediate rollers 82, and paper cassette 83. A take-up roller 84 is provided so as to confront the cassette 83. At the left side of the photosensitive drum 1 in the drawing, are provided a pair of fixing rollers 91 and a pair of discharge rollers 92, said discharge rollers 92 being arranged so as to confront a discharge tray 93.

The aforesaid components are installed in the printer body 10. The printer body 10 comprises a lower unit 101 and an upper unit 102. The charger 2, developing unit 3, cleaning device 5, eraser 6, optical unit 7, top timing roller of the timing roller pair 81, top intermediate roller of the intermediate roller pair 82, take-up roller 84, top fixing roller 91 of the fixing roller pair 91, discharge roller pair 92, and discharge tray 93 are all provided in the upper unit 102. An end of the upper unit can be opened and closed in one direction and an opposite direction on the paper feeding side by pivoting on shaft 103 attached to the end portion of the printer at the left side in the drawing. This opening capability allows for clearing paper jams and various routine maintenance procedures.

The photosensitive drum 1, charger 2, developing unit 3, and cleaning device 5 are integratedly formed as an imaging cartridge so as to be removably installed in the printer body 10.

According to this printer, the surface of the photosensitive drum 1 is uniformly charged to a predetermined electrical potential via the charger 2, the charged area of said surface is irradiated by image exposure light from the optical unit 7, and an electrostatic latent image is formed thereby. The formed latent image is developed by the developing unit 3 so as to form a toner image which advances to the transfer area confronting the transfer charger 4.

On the other hand, a transfer sheet is fed from the cassette 83 via the take-up roller 84, and is transported through the intermediate roller pair 82 to the timing roller pair 81, which transports the transfer sheet to the transfer area synchronously with the toner image on the rotating drum 1. At the transfer area, the toner image formed on the surface of the photosensitive drum 1 is transferred onto the transfer sheet via the action of the transfer charger 4, and after said transfer the sheet is transported to the fixing roller pair 91. After the toner image is fused onto the transfer sheet, the sheet is discharged to the discharge tray 93 via the discharge roller pair 92.

After the toner image has been transferred to the transfer sheet, the residual toner remaining on the surface of the photosensitive drum 1 is removed therefrom by means of the cleaning device 5, and the residual charge remaining on the surface of the photosensitive drum 1 is eliminated by the eraser 6.

The system speed (circumferential speed of the photosensitive drum 1) of the aforesaid printer is 3.5 cm/second. The developing unit 3 is a monocomponent contact type developing device which performs reversal development.

The photosensitive drum 1 of the present embodiment is an organic photosensitive member of the function-separation type with a negative chargeability and having a sensitivity to long-wavelength light.

The toner used in the developing unit 3 is a negative-charging polyester type toner. When this type of toner is accommodated in the developing unit 3, development is accomplished under developing bias voltage of 300 V.

Figure 2:
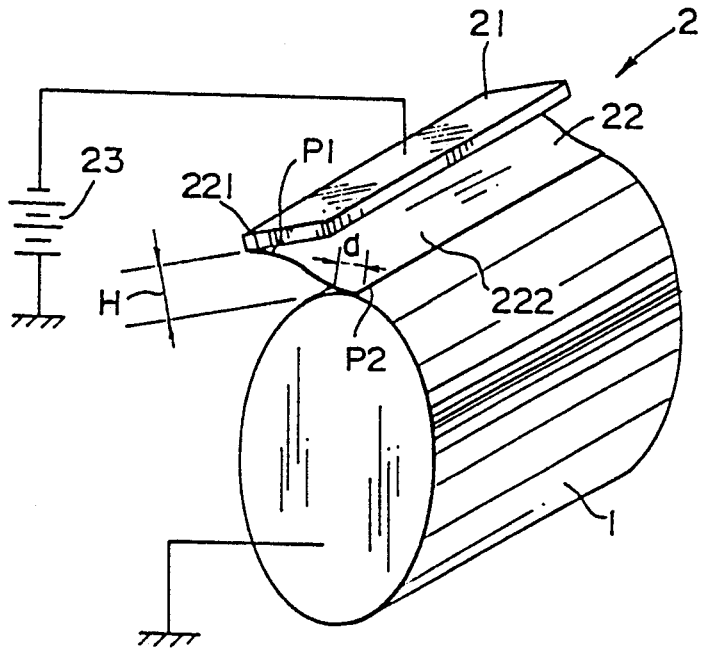
FIG. 2 is a brief illustration showing the film charger of the present invention.
Figure 3:
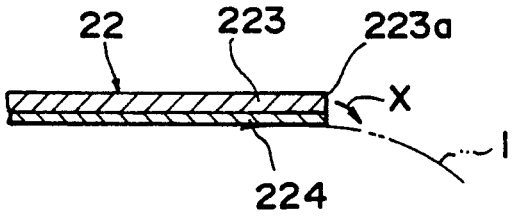
FIG. 3 is a section view showing the film charger of the present invention.

The basic construction of the charger used in the aforesaid printer is described hereinafter with reference to FIG. 2. The charger 2 comprises a film supporting conductive support plate 21 (an aluminum support plate in the present example) and a charging film 22, the supported end 221 of which is supported by the support plate 21, and the free end 222, i.e., the portion of part 222 from the end P1 of the film support area to the film free end P2, of which makes contact with the surface of the photosensitive drum 1, as shown in FIG. 2. The film 22 has a two-layer construction comprising an electrically conductive substrate 223 and an electrically insulating overcoat layer 224 superimposed thereon, such that the insulating overcoat layer 224 makes contact with the photosensitive drum 1, as shown in FIG. 3. The support plate 21 extends in the axial direction of the photosensitive drum 1 and is set at a distance H=2 mm from the surface thereof. The length of the film 22 between the supported end P1 and the free end P2 is 10 mm in the present example. A power source 23 is connected to the support plate 21 to apply a negative voltage charge thereto.

A second embodiment of the charger 2 of the present invention is described hereinafter. Before proceeding with the description of the second embodiment, we will discuss the methods for measuring and evaluating the electrical potential ($V_o$) on the surface of the photosensitive drum produced by the charger 2, and the method for evaluating charging irregularities and the image noise based on said irregularities.

1) Measurement and evaluation of surface potential ($V_o$) of the photosensitive drum.

A voltage of $-1.1$ kV was applied to the charging film 22 via the aluminum support plate 21 of the charger 2, so as to charge the surface of the photosensitive drum. The probe of a surface potentiometer (Trek, model 360) was set at the developing position, and the charging potential on the surface of the photosensitive drum was measured.

2) Evaluation of image noise based on charging irregularities.

According to the device of the present invention, charging irregularities are generated in a direction perpendicular to the surface advance of the photosensitive drum 1. The charge irregularities remained even after image exposure as a post-exposure potential ($V_i$) irregularity. That is, among the areas of the potential ($V_o$) directly after charging by the charger 2, the parts having a partially high potential have a partially high potential ($V_i$) after image exposure.

When performing reversal development in the previously described printer, the parts of low potential ($V_i$) are developed with excessive quantities of toner. In other words, the irregularity of potential ($V_o$) results in an irregularity of potential ($V_i$), and finally image irregularity. One of the performance capabilities of the charger of the present invention is to manage the generative condition of the aforesaid image irregularity. Evaluation of the degree of the image irregularity was accomplished by evaluating image noise.

Figure 5:
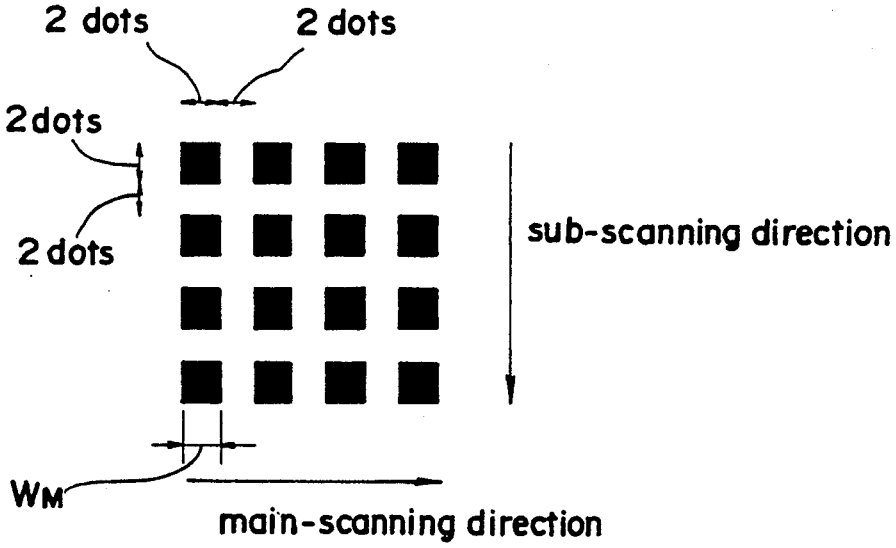
FIG. 5 is an illustration describing an evaluation of an embodiment of the present invention.

Image noise evaluation was accomplished as follows. Using the previously described printer, the photosensitive drum was charged by the charger 2, and written to via the laser light from the optical unit 7 in a repetitive two-dots ON (lighted), two-dots OFF (extinguished) pattern in the main scanning direction, and a similar two-dots ON (lighted) and two-dots OFF (extinguished) pattern in the sub-scanning direction, by regulating the laser timing. Thereafter, reversal development, transfer and fixing processes were accomplished to produce the print image shown in FIG. 5.

The maximum width of the fine black pattern comprising two-dots by two-dots of the print image in the main scanning direction was defined as Wx. The standard deviation for thirty consecutive fine black patterns Wx in the main scanning direction was defined as $\nu$, and image noise rankings were accomplished using the value $\nu$ in the following manner.

| Standard Deviation $\sigma$ | Evaluation Rank |
|---|---|
| $0\ \mu m \leqq \sigma < 10\ \mu m$ | 5 (no problem) |
| $10\ \mu m \leqq \sigma < 20\ \mu m$ | 4 (no problem) |
| $20\ \mu m \leqq \sigma < 30\ \mu m$ | 3 (practical limit) |
| $30\ \mu m \leqq \sigma < 40\ \mu m$ | 2 (impermissible level) |
| $40\ \mu m \leqq \sigma$ | 1 (impermissible level) |

The evaluations are described by practical examples hereinafter.

In one example, the charging film 22 had a polyethylene film ($10^4\ \Omega cm$) having a thickness of 50 $\mu m$ incorporating a dispersion of conductive carbon black as the electrically conductive substrate layer 223, and an application of acrylic resin ($10^{16}\ \Omega cm$) having a thickness of about 5 $\mu m$ was superimposed on the conductive substrate layer to form the insulating overcoat layer 224. The bending moment M of the film was about 20 (g.cm) according to FIG. 4.

Figure 6:
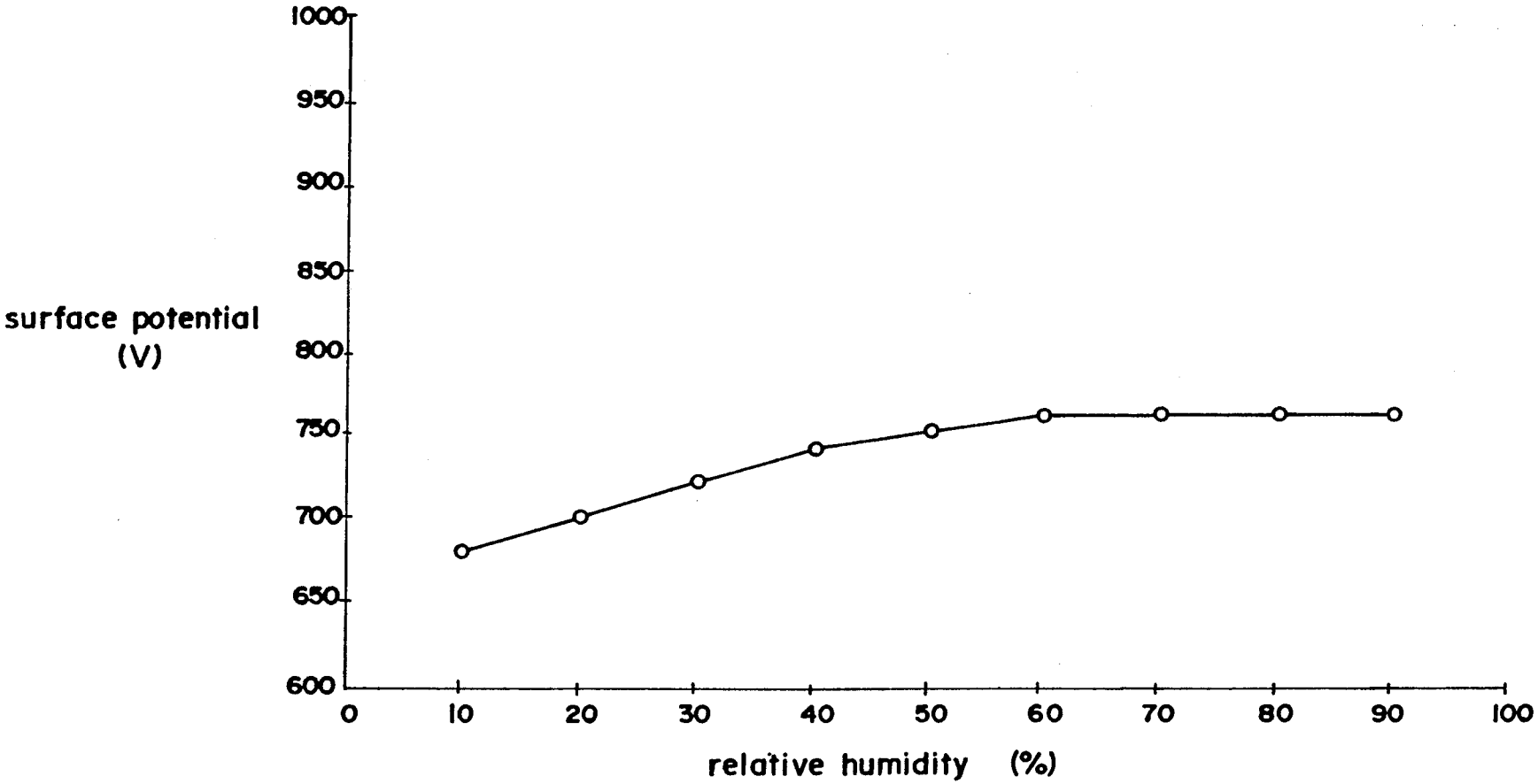
FIGS. 6 and 7 are graphs showing experimental results of an embodiment of the present invention.
Figure 7:
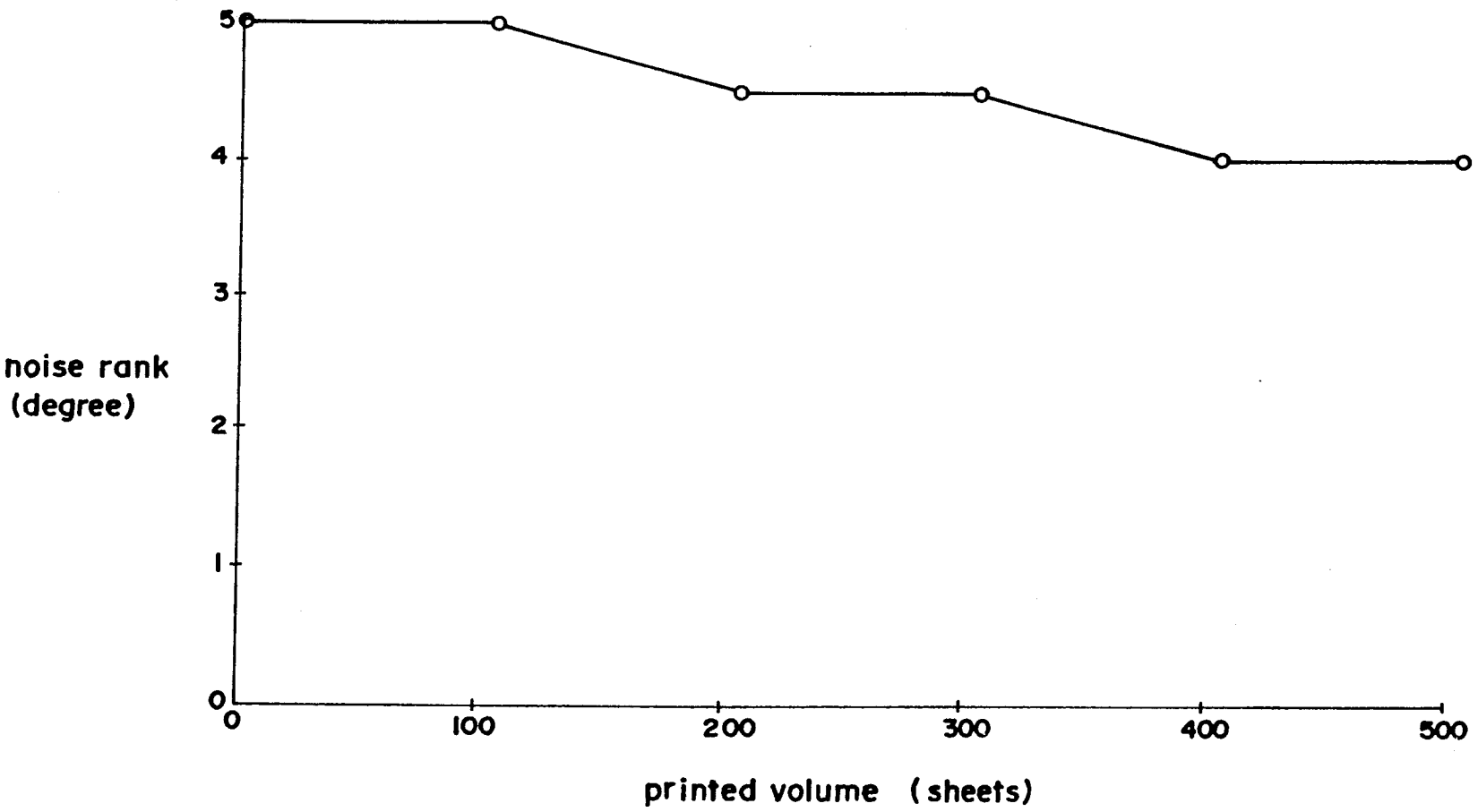

The aforesaid embodiment of the present invention was incorporated in the previously described printer. FIG. 6 shows the surface potential of the drum 1 and the relative humidity when a voltage of $-1.2$ volts was applied as the charging voltage to charge the surface of the photosensitive drum 1. FIG. 7 shows the evaluation results based on the previously described noise evaluation method, i.e., the relationship between the printed volume and the image noise rank.

As can be understood from FIG. 6, the breadth of environmental fluctuation in the present embodiment was stable over about 80 volts. It is believed that the discharge occurred from the free end 223*a* of the conductive layer 223, as indicated by the X in FIG. 3, and the largely environment-dependent injection charge was restricted via the presence of the insulating overcoat layer 224. The length of print service life of the film can be understood from FIG. 7. Soiling of the discharge portion was also believed to be restricted by the presence of the insulating undercoat layer 224.

EMBODIMENT 2

Another embodiment of the invention was produced as a charging film 22 having a laminate construction wherein a polyester film insulating overcoat layer 224 having a thickness of 30 $\mu m$ was superimposed on an aluminum conductive layer 223 having a thickness of 50 $\mu m$. In the insulating overcoat layer 224 was formed a uniform dispersion of a plurality of fine pores 224*a* having a diameter of 0.5 mm to achieve an overall porosity of 80%.

This embodiment was also incorporated in the previously described printer. A charging voltage of $-1.2$ kV was applied to charge the surface of the photosensitive drum 1, and when the relationship between the surface potential of the drum and the relative humidity was checked, the breadth of environmental fluctuation was minimal, as in the previous embodiment. The relationship between printed volume and noise rank was evaluated in the same way as in the first embodiment, and it was found that service life was prolonged in the same way as in the first embodiment. Further testing revealed that discharge occurred not only from the free end 223*a* of the conductive substrate layer 223 (refer to FIG. 8), but also occurred from the pores 224*a* of the insulating overcoat layer 224. Furthermore, the film 22 bonded well with the surface of the photosensitive drum 1, which alone produced uniform charging.

The present invention provides a contact charger of high reliability capable of excellent and stable charging under conditions which inhibit the occurrence of image noise and restrict environmental fluctuation, and further provides a simple and low cost charger inasmuch as construction is simplified compared to conventional contact chargers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A contact charger for charging an image carrier having a surface, comprising:

a support member;

a flexible film supported at a side end portion by the support member and having a free end portion adapted to contact the surface of the image carrier, said film having a bending moment M defined by the following formula, $$0.001(g.cm) \leqq M \leqq 20(g.cm),$$

$$M = EI/\rho$$

wherein E is Young's modulus ($g/cm^2$) of the film, I is the second moment of area ($cm^4$) of the film which is obtained by the formula $I = bh^3/12$ wherein b is the width (cm) of the film, h is the thickness (cm) of the film, and $\rho$ is a radius of curvature (cm) of the film when the film is curved, said bending moment M obtained when $b = 1$ (cm) and $\rho = 0.5$ (cm) are set, wherein the flexible film includes an electrically conductive layer and an electrically insulated overcoat layer superposed onto the conductive layer; and a power source for applying a charging voltage to the film to charge the surface of the image carrier.

2. A contact charger as claimed in claim 1, wherein the overcoat layer has a thickness of 0.1 to 100 (micrometer).

3. A contact charger as claimed in claim 2, wherein the overcoat layer has an electrical resistivity of $10^{16}$ (ohm-cm) or more.

4. A contact charger as claimed in claim 1, wherein the conductive has layer on electrical resistivity of $10^{-4}$ to $10^{10}$ (ohm-cm).

5. A contact charger as claimed in claim 1, wherein the overcoat layer has a thickness of 0.1 to 100 (micrometer) and an electrical resistivity of $10^{16}$ (ohm-cm) or more and the conductive layer has an electrical resistivity of $10^{-4}$ to $10^{10}$ (ohm-cm).

6. A contact charger as claimed in claim 1, wherein the overcoat layer has a plurality of fine pores.

7. A contact charger as claimed in claim 6, wherein at least one of the fine pores has a diameter of 0.05 to 1.00 (mm) and the fine pores are provided on the surface of the overcoat layer in the ratio 70 to 80 (%) to the whole surface-area of the overcoat layer.

8. An image forming apparatus includes a contact charger for charging an image carrier having a surface, said contact charger comprising:

a support member;

a flexible film supported at a side end portion by the support member and having a free end portion adapted to contact the surface of the image carrier, said film having a bending moment M defined by the following formula, $$0.001(\text{g.cm}) \leqq M \leqq 20\ (\text{g.cm}),$$

$$M = EI/\rho$$

wherein E is Young's modulus (g/cm$^2$) of the film, I is the second moment of area (cm$^4$) of the film which is obtained by the formula $I = bh^3/12$ wherein b is the width (cm) of the film, h is the thickness (cm) of the film, and $\rho$ is a radius of curvature (cm) of the film when the film is curved, said bending moment M obtained when $b = 1$ (cm) and $\rho = 0.5$ (cm) are set, wherein the flexible film includes an electrically conductive layer and an electrically insulated overcoat layer superposed onto the conductive layer; and a power source for applying a charging voltage to the film to charge the surface of the image carrier.

9. An image forming apparatus as claimed in claim 8, includes means for forming an electrostatic latent image on the image carrier and means for reversibly developing the electrostatic latent image with toner particles charged to the same polarity as the electrostatic latent image.

10. A contact charger for charging an image carrier having a surface, comprising:

a support member;

a flexible film supported at a side end portion by the support member and having a free end portion adapted to contact the surface of the image carrier, said film having fine pores on the surface which contacts the surface of the image carrier; and a power source for applying a charging voltage to the film to charge the surface of the image carrier 11. A contact charger as claimed in claim 10, wherein at least one of the fine pores has a diameter of 0.05 to 1.00 (mm) and the fine pores are provided on the surface of the film in the ratio 70 to 80 (%) to the whole surface-area of the overcoat layer.

12. A contact charger as claimed in claim 10, wherein the film has a bending moment M defined by the following formula, $$0.001(\text{g.cm}) \leqq M \leqq 20(\text{g.cm}),$$

$$M = EI/\rho$$

wherein E is Young's modulus (g/cm$^2$) of the film, I is the second moment of area (cm$^4$) of the film which is obtained by the formula $I = bh^3/12$ wherein b is the width (cm) of the film, h is the thickness (cm) of the film, and $\rho$ is a radius of curvature (cm) of the film when the film is curved, said bending moment M obtained when $b = 1$ (cm) and $\rho = 0.5$ (cm) are set.

13. A contact charger as claimed in claim 10, wherein the film includes an electrically conductive layer and an electrically insulated overcoat layer superposed onto the conductive layer.

14. A contact charger as claimed in claim 13, wherein the overcoat layer has a thickness of 0.1 to 100 (micrometer).

15. A contact charger as claimed in claim 14, wherein the overcoat layer has an electrical resistivity of $10^{16}$ (ohm-cm) or more 16. A contact charger as claimed in claim 13, wherein the conductive layer has an electrical resistivity of $10^{-4}$ to $10^{10}$ (ohm-cm)

17. A contact charger as claimed in claim 13, wherein the overcoat layer has a thickness of 0.1 to 100 (micrometer) and an electrical resistivity of $10^{16}$ (ohm-cm) or more and the conductive layer has an electrical resistivity of $10^{-4}$ to $10^{10}$ (ohm-cm).

* * * * *